US005476217A

United States Patent [19]

Moncrief et al.

[11] Patent Number: 5,476,217

[45] Date of Patent: Dec. 19, 1995

[54] CARTON BOTTLE PARTITION

[75] Inventors: Frank Moncrief, Acworth; James C. Fogle, Marietta, both of Ga.; Charles McNamara, Tucson, Ariz.

[73] Assignee: Riverwood International Corporation, Atlanta, Ga.

[21] Appl. No.: 330,488

[22] Filed: Oct. 28, 1994

[51] Int. Cl.[6] ..... B65D 5/492

[52] U.S. Cl. ..... 229/120.27; 53/263; 229/120.26

[58] Field of Search ..... 229/120.24, 120.26, 229/120.27, 120.36, 120.29; 53/255, 263, 539

[56] References Cited

U.S. PATENT DOCUMENTS

| | | | |
|---|---|---|---|
| 3,031,813 | 5/1962 | Ganz | 229/120.27 |
| 3,478,947 | 11/1969 | Schillinger | 229/120.27 |
| 3,662,879 | 5/1972 | Helms | 229/120.27 |
| 3,868,055 | 2/1975 | Langen et al. | 229/120.27 |
| 4,062,448 | 12/1977 | Meighan | 229/120.26 |
| 4,151,788 | 5/1979 | Wiseman | 53/263 |
| 4,172,546 | 10/1979 | Oliff et al. | 229/120.27 |
| 4,417,684 | 11/1983 | Skaggs | 229/120.27 |
| 4,632,300 | 12/1986 | Bartlett | 229/120.26 |
| 5,209,393 | 5/1993 | Xapelli | 229/120.27 |

*Primary Examiner*—Gary E. Elkins

[57] ABSTRACT

A divider panel for separating bottles in a carton. The divider panel is provided with shock absorbing feet so that upon being propelled at high speed into a group of adjacent bottles, the feet distort upwardly upon impact. This prevents the divider from bouncing out of the group as it would if the feet were not provided. Cutouts in the upper edge portions of the divider panel allow the panel blanks to be conveniently delivered to the insertion station.

13 Claims, 2 Drawing Sheets

CARTON BOTTLE PARTITION

FIELD OF THE INVENTION

This invention relates to partitions for separating bottles in a carton. More particularly, it relates to a partition designed to facilitate entry into a bottle group.

BACKGROUND OF THE INVENTION

Paperboard partitions are used to separate adjacent bottles in a carton or carrier to prevent the bottles from contacting each other. This protects against breakage due to vibration and shock during shipping and handling. Typically, a partition used to separate the bottles of two adjacent rows consists of a panel situated between the rows, including transverse dividers which extend out from the panel between adjacent bottles in each row. Thus for a package containing six bottles arranged in two adjacent rows, the partition would include two transverse dividers. For packages containing a greater number of bottles the partition would include additional transverse dividers as necessary. Additional partitions are conventionally employed in a package containing multiples of these basic bottle groups to separate the bottles within each group, and a straight partition or divider is employed to separate the bottles of adjacent groups. In a typical packaging operation the transverse dividers of a partition blank are folded out of the plane of the blank to their final operative condition and the opened partition is inserted into a group of bottles by insertion equipment prior to loading the bottles into a carton.

Because the partitions are inserted from a fixed station of a packaging machine into a moving stream of bottles, the partitions must move rapidly into place so as to be properly located between the bottles of each group. If the partitions are moved into place too slowly, proper placement could be interfered with by the moving upstream bottles and could cause a temporary shut-down of the packaging machine to correct the problem. Rapid movement of the partitions into a bottle group is desirable in order to avoid such problems and to be capable of accommodating greater machine speeds. It has been found, however, that when the partitions are inserted at higher speeds they strike the hard surface over which the bottles are moving with such force that they tend to bounce back up out of the bottle group before they have a chance to be lodged into place. This of course is unacceptable.

It would be highly desirable and beneficial to be able to insert bottle partitions at rapid speeds while ensuring that the partitions will stay in place and not bounce back out.

BRIEF SUMMARY OF THE INVENTION

The bottle partition of the invention is comprised of a divider panel having at least one foldably connected partition wing and spaced shock absorbing feet integral with the divider panel. The feet extend down beyond the lower edge of the divider panel and are of such size and construction as to distort upwardly upon impacting a substantially unyielding surface, which occurs during insertion of the partition between bottles of a bottle group. Preferably, the feet have downwardly and inwardly tapered side edges and are located adjacent the side edges of the divider panel.

In a preferred design the blanks from which the partitions are formed include cutouts extending into the side edges of the divider panel which allow the blanks to be supported on rails extending through the cutouts as they are delivered to the insertion station.

The invention prevents the partitions from bouncing out of bottle groups into which they have been inserted at high speed while allowing the partitions to settle into place on their bottom edge. Other aspects and benefits of the invention will be readily apparent from the more detailed description of the preferred embodiment which follows.

DETAILED DESCRIPTION OF THE PREFERRED EMBODIMENT

Figure 1:
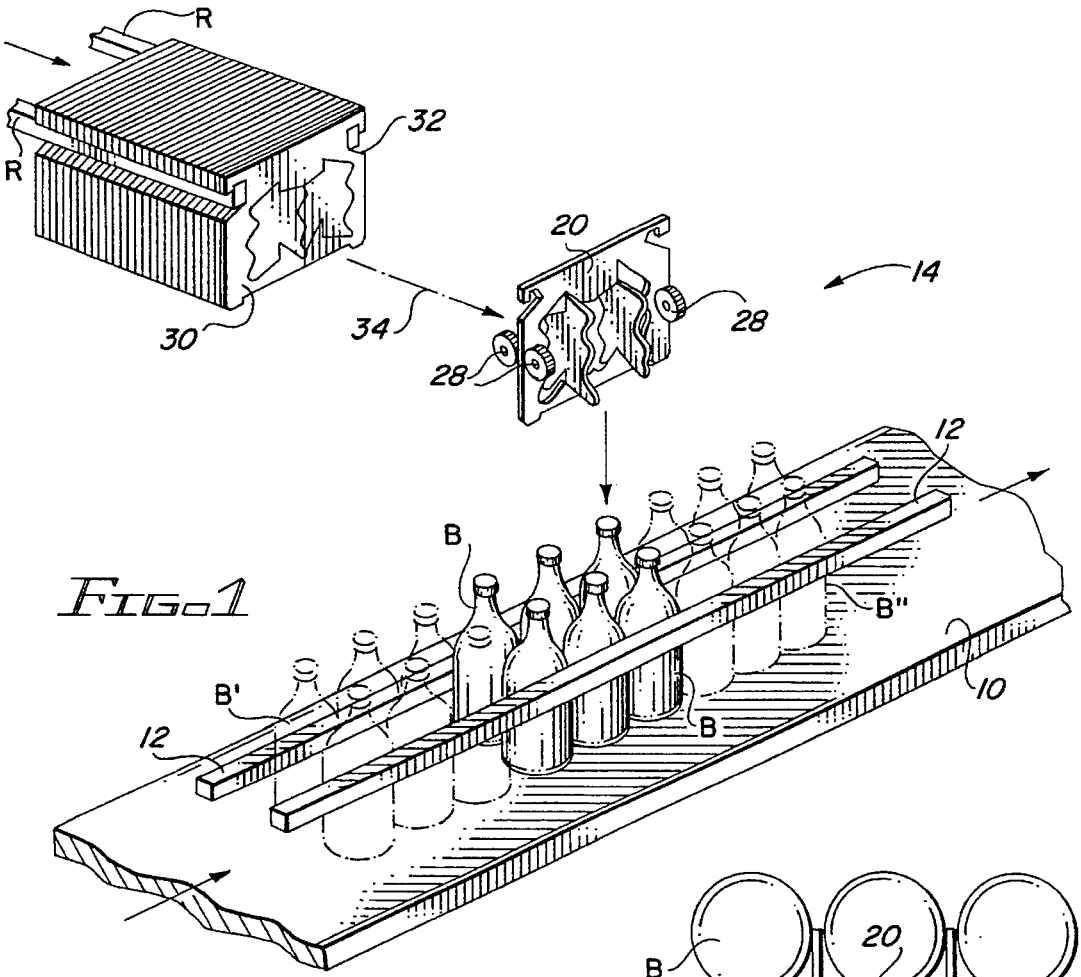
FIG. 1 is a simplified pictorial view of a partition inserting station of a packaging machine where the partitions of the present invention are inserted into a moving bottle group.

Referring to FIG. 1, a stream of two rows of bottles B, B' and B" are shown moving over the stationary support 10 between guide rails 12 past a partition insertion station 14. The bottles may be moved over the support surface by any desired means. Typically an infeed conveyor, not shown, pushes bottles onto the support 10 at an upstream location. Each bottle as it leaves the conveyor pushes the next downstream bottle another increment in the downstream direction, causing that bottle and all bottles downstream in the same row to slide over the surface of the support 10. The bottles B comprise a group of six bottles to be eventually loaded into a six-bottle carrier or into one side of a twelve-bottle carrier. The bottles B', shown in broken lines to better distinguish them from the bottles B at the insertion station, represent the bottles upstream of the bottles B while the bottles B", also shown in broken lines, represent downstream bottles which have already passed through the partition insertion station.

Figure 2:
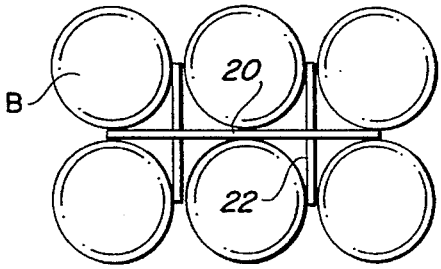
FIG. 2 is a simplified plan view of a typical partition arrangement for a bottle group made up of six bottles.

The relationship of a partition to the bottles B after insertion of a partition into a bottle group is illustrated in FIG. 2, which shows a partition 20 arranged between two rows of bottles, with transverse cross pieces or dividers 22 extending between adjacent bottles in each row. If the bottles were to be loaded into a twelve-bottle carrier a similar group of six bottles would be introduced to the carrier, separated from the first group by a planar divider panel. Obviously, other bottle arrangements are possible. For example, instead of two rows of bottles being moved past the inserting station, the bottles could be moved in four rows, in which case two partitions 20 and a planar divider would be inserted at the station.

Referring back to FIG. 1, as the bottles travel beneath the partition insertion station 14 the partitions 20 are propelled into a predetermined bottle group by rotating wheels 28. The partitions are typically provided in the form of flat blanks 30 having cutouts or notches 32 which allow the blanks to be supported on rails R in face-to-face relationship. In practice, the blanks would preferably be housed in a magazine rather than in the open arrangement shown, which has been simplified for the purpose of illustrating the invention. As indicated by the dotted arrow 34, the end blank is moved to the inserting station 14 and opened into partition form. This may be carried out by any desired means capable of folding out the cross dividers from the plane of the blank. The details of the moving means and the opening means have not been shown since such devices are well known in the industry and the details are not necessary to an understanding of the invention.

Figure 3:
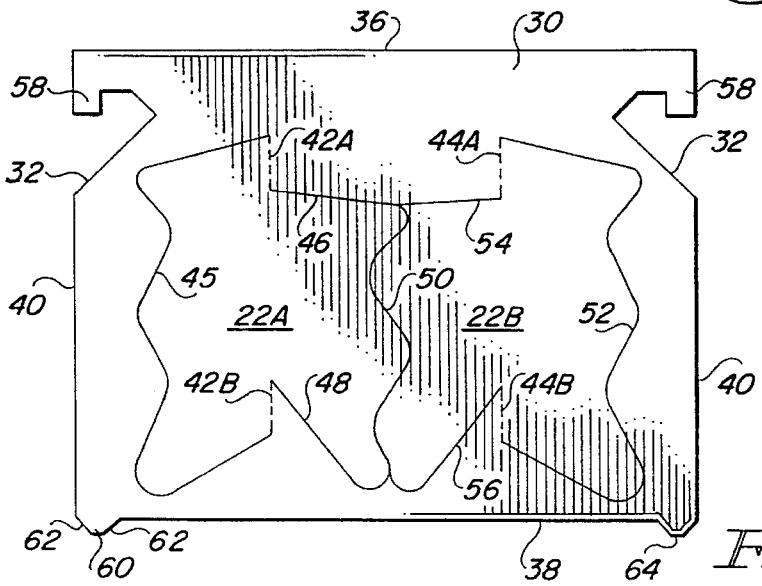
FIG. 3 is an enlarged plan view of a blank for forming the partition of the invention.

As shown in FIG. 3, a blank 30 comprises a substantially rectangular sheet of relatively thick paperboard or other material from which foldably connected integral dividers can be formed. The blank includes upper and lower edges 36 and 38, respectively, and side edges 40 which extend substantially at right angles to the upper and lower edges. Fold lines 42 and 44, which are spaced from the edges of the blank and from each other, extend substantially parallel to the side edges. Each fold line is comprised of interrupted segments connected by slits to form partition wings or dividers 22. Thus, slit 45 connects the remote ends of fold lines segments 42A and 42B, while the near ends of the fold line segments are connected by slits 46 and 48 and the slit 50. The area bounded by these fold line segments and slits comprises a partition wing or cross divider 22A. Similarly, the remote ends of fold line segments 44A and 44B are connected by slit 52, while the near ends of the fold line segments are connected by slits 54 and 56 and by the common slit 50 to form partition wing 22B.

As indicated above, the upper portions of the side edges 40 of the blank are notched at 32 to form support hooks 58 which hold the blank in place relative to the guide rails R shown in FIG. 1. The bottom corner areas of the blank extend beyond the lower edge 38 to form substantially triangular feet 60 having downwardly and inwardly tapered side edges 62 terminating in a short bottom edge 64.

Figure 4:
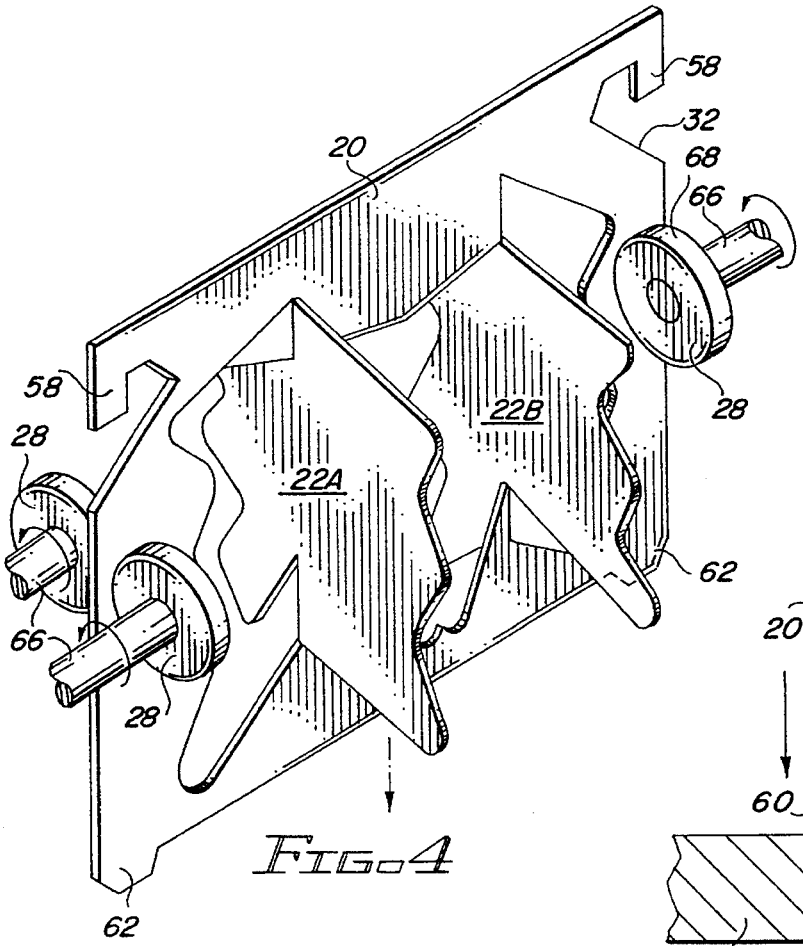
FIG. 4 is an enlarged pictorial view of a partition shown as it is about to be downwardly propelled by propelling wheels.

To open the wings 22A and 22B it is merely necessary to fold them out about their fold lines 42 and 44 to a position at right angles to the remainder of the blank. As indicated above, this may be done by mechanism well known in the art. Except for the lack of speed in opening the wings, the opening process could also readily be done by hand. The resulting partition appears as in FIG. 4, with the partition wings extending out from the body of the blank. The partition is illustrated just before it is propelled downward by the wheels 28. The wheels are mounted on the ends of rotating shafts 66 and preferably are knurled or rubber-coated as indicated at 68 in order to better grip the side edge portions of the partition. Rapid rotation of the wheels then propels the partitions with great speed down between the bottles.

Figure 5A:
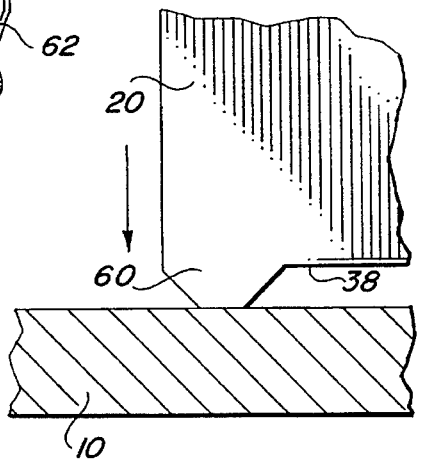
FIG. 5A is an enlarged partial longitudinal sectional view taken through a portion of the support surface over which bottles are moving toward a loading station as the surface is initially contacted by a partition being inserted into a bottle group.
Figure 6:
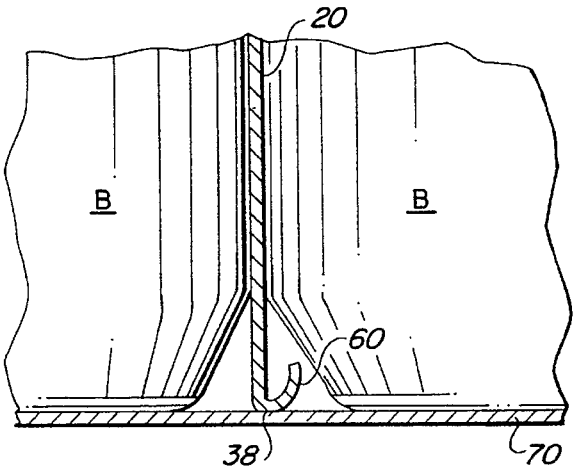
FIG. 6 is an enlarged partial transverse sectional view taken through the bottom panel of a carton showing the bottom end portion of the partition of FIG. 5B as it relates to adjacent bottles in the carrier.
Figure 5B:
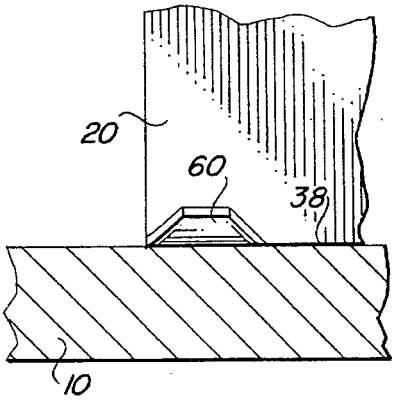
FIG. 5B is an enlarged partial longitudinal sectional view similar to that of FIG. 5A, but illustrating the bottom of the partition just after it strikes the bottle support surface.

If the partition had no feet and struck the support 10 with a continuous bottom edge it would tend to bounce back up, often bouncing out of position. This occurs because both the bottom edge of the partition and the support table 10, which is commonly comprised of steel or plastic, are hard and unyielding. Since the support table absorbs substantially none of the of the kinetic energy of the rapidly moving partition the partition bounces up with great speed. In accordance with the invention, the impact of the feet 60 with the support 10 causes the feet to fold or collapse progressively from their ends to their base, thus absorbing the bulk of the energy of the collision. This action is illustrated in FIGS. 5A and 5B. The moment of impact of one of the feet is depicted in FIG. 5A, while FIG. 5B depicts the foot in its final condition, folded or crushed up to the point where it allows the bottom edge 38 of the partition to contact the support surface. The final condition of a partition foot with respect to the bottom panel 70 of a carton and to the packaged bottles B is illustrated in FIG. 6. Note that the conventional inwardly tapered shape of the bottom portion of the bottles provides room for the partition feet to fold up.

Although the shock absorbing feet of the partition are illustrated as having short flat bottom edges which make the shape of the feet a truncated triangle, they could just as well terminate in a point to make them fully triangular. However the bottom edge is formed, it is desirable to provide the feet with tapered side edges so that the base of the feet, where they connect with the bottom edge 38 of the partition, is wider than the tip. With this construction the ends of the feet, being relatively narrow, readily begin to crumble up at impact, absorbing some of the energy. The greatest amount of energy is absorbed by the continued crumbling or folding of the progressively wider portions of the feet, inasmuch as the folding of a wider surface requires more energy than the folding of a narrow surface.

It can be appreciated that the specific design and dimensions of the shock absorbing feet will vary with conditions, depending on the size of the partitions, the speed at which they are propelled into a bottle group and the thickness and rigidity of the partition material. In any event, the width of the feet should be very small compared to the overall length of the partition and the feet should not be so closely spaced apart that together they present too much resistance to yielding. On the other hand, the overall size of the feet cannot be so small that they are not able to slow the speed of the partition to the point of preventing it from bouncing up out of a bottle group. The optimum dimensions, shape and spacing are therefore best determined by experimentation for each particular carton design. The illustrated design is preferred because the feet are widely spaced apart and because their formation at the side edges of the partition allows economies of partition layout in the manufacture of partition blanks.

Although described with respect to a six-bottle group, the invention can be employed with other group sizes by making the partitions larger, or by using fewer or greater numbers of partitions in a carrier or by providing the partitions with fewer or more partition wings. In any event, such partitions would be provided with shock absorbing feet as described above.

It can now be appreciated that the invention has substantial economic benefits over the use of conventional bottle partitions, allowing partitions to be more rapidly sent into a carrier to enable a packaging machine to be run at higher speeds while at the same time preventing shutdowns of the packaging machine due to the previously unsolved problems of partition bouncing at high speeds.

It will be understood that the invention is not necessarily limited to all the specific details described in connection with the preferred embodiments, but that changes to certain features of the preferred embodiments which do not alter the overall basic function and concept of the invention may be made without departing from the spirit and scope of the invention defined in the appended claims.

What is claimed is:

1. A partition for separating adjacent bottles in a carton, comprising:

a divider panel having upper, lower and side edges;

at least one partition wing foldably connected to and extending transversely of the divider panel; and spaced shock absorbing feet integral with the divider panel and extending downwardly beyond the lower edge thereof, each shock absorbing foot being of such size and construction as to distort upwardly upon impacting a substantially unyielding surface during insertion of the partition into a group of adjacent bottles.

2. A partition as recited in claim 1, wherein the partition wing extends in opposite directions from the divider panel, the partition wing being connected to the divider panel by spaced fold lines.

3. A partition as recited in claim 1, wherein the shock absorbing feet have downwardly and inwardly tapered side edges.

4. A partition as recited in claim 3, wherein the shock absorbing feet are located adjacent the side edges of the divider panel.

5. A blank for forming a partition for separating adjacent bottles in a carton, comprising:

a generally rectangular sheet forming a divider panel having upper, lower and side edges;

at least one partition wing bounded by a fold line having ends and continuous slits connected to the ends of the fold line, the partition wing extending transversely of the divider panel in a partition formed from the blank;

spaced shock absorbing feet extending beyond the lower edge of the divider panel, each shock absorbing foot being of such size and construction as to distort upwardly upon impacting a substantially unyielding surface during insertion of a partition formed from the blank into a group of adjacent bottles.

6. A blank as recited in claim 5, wherein there are two partition wings, and wherein the fold lines of the partition wings are comprised of spaced fold line segments, a continuous slit connecting remote ends of the fold line segments of each partition wing and another continuous slit connecting the opposite ends of the fold line segments of each partition wing.

7. A blank as recited in claim 5, wherein the shock absorbing feet have downwardly and inwardly tapered side edges.

8. A blank as recited in claim 7, wherein the shock absorbing feet are located adjacent the side edges of the divider panel.

9. A blank as recited in claim 5, including cutouts extending into the side edges of the divider panel near the upper edge of the divider panel, whereby the blank can be supported on rails extending through the cutouts prior to forming a partition from the blank.

10. A method of inserting a bottle partition into a group of adjacent bottles supported on a substantially unyielding surface, comprising:

providing a divider panel having upper, lower and side edges, at least one partition wing foldably connected to and extending transversely of the divider panel and spaced shock absorbing feet integral with the divider panel and extending downwardly beyond the lower edge thereof, each shock absorbing foot being of such size and construction as to distort upwardly upon impacting the substantially unyielding surface; and propelling the divider panel downwardly between bottles in the carton with sufficient force to cause the shock absorbing feet to distort upwardly upon striking the substantially unyielding surface.

11. A method as recited in claim 10, wherein the shock absorbing feet have downwardly and inwardly tapered side edges, the distortion of the shock absorbing feet initiating at the lowermost ends of the side edges of the feet.

12. A method as recited in claim 11, wherein the shock absorbing feet are located adjacent the side edges of the divider panel.

13. A method as recited in claim 10, wherein the divider panel is formed from a blank including cutouts extending into the side edges of the divider panel near the upper edge thereof, the method including the steps of supporting the blank on rails extending through the cutouts prior to propelling the partition into the carton.

* * * * *